United States Patent [19]

Windorski

[11] Patent Number: 4,796,781

[45] Date of Patent: Jan. 10, 1989

[54] DISPENSER FOR A STACK OF NOTEPAPER

[75] Inventor: David C. Windorski, Woodbury, Minn.

[73] Assignee: Minnesota Mining and Manufacturing Company, St. Paul, Minn.

[21] Appl. No.: 29,172

[22] Filed: Mar. 23, 1987

[51] Int. Cl.[4] ..... B65H 1/00

[52] U.S. Cl. ..... 221/45; 221/52; 312/61

[58] Field of Search ..... 221/52, 56, 57, 61, 221/45, 63, 33, 312 C, 279; 206/39.5, 39.6, 39.7, 39; 312/61

[56] References Cited

U.S. PATENT DOCUMENTS

| | | | |
|---|---|---|---|
| 1,026,549 | 5/1912 | Almond . | |
| 1,377,565 | 5/1921 | Dickerson | 221/59 |
| 1,508,020 | 9/1924 | Horwitt | 221/56 |
| 1,696,556 | 12/1928 | Schofer | 221/56 |
| 1,707,578 | 4/1929 | Shaffer | 221/45 |
| 2,082,765 | 6/1937 | Krueger | 221/52 |
| 2,237,532 | 4/1941 | Posnack | 231/44 |
| 2,609,219 | 9/1952 | Marano | 281/44 |
| 2,802,567 | 8/1957 | Covel | 206/57 |
| 2,872,067 | 2/1959 | Gessner et al. | 221/33 |
| 3,223,235 | 12/1965 | Knip | 206/74 |
| 3,307,740 | 3/1967 | Font | 221/45 |
| 3,343,716 | 9/1967 | Peebles | 221/52 |
| 4,416,392 | 11/1983 | Smith | 221/45 |
| 4,653,666 | 3/1987 | Mertens | 221/45 |

FOREIGN PATENT DOCUMENTS

| | | | |
|---|---|---|---|
| 1016522 | 11/1952 | France | 221/45 |
| 24066 | of 1903 | United Kingdom | 221/52 |

*Primary Examiner*—H. Grant Skaggs

*Attorney, Agent, or Firm*—Donald M. Sell; John C. Barnes

[57] ABSTRACT

A desk type dispenser for dispensing note sheets which are adhered together along opposite alternate edges by a narrow band of adhesive coated on one surface of the sheets comprises a base member and a body member. The body is preferably weighted and sits on the uppermost sheets in the stack and is provided with a dispensing opening therein which communicates with arcuate wall members communicating with the bottom surface thereof. Recesses in one of the body and base and projections in the other member cooperate to afford a nesting of the base and the body. A platform on one of the members and a recess on the other affords a positioning of the stack of sheets with respect to the two members and stability for the stack of sheets.

12 Claims, 2 Drawing Sheets

DISPENSER FOR A STACK OF NOTEPAPER

BACKGROUND OF THE INVENTION

1. Field of the Invention

This invention relates to a dispenser for dispensing individual sheets of paper from a stack of notepaper, and in one aspect, to a novel refillable desk top notepaper dispenser.

2. Description of the Prior Art

The present invention relates to an improvement in a refillable dispenser for use in dispensing sheets of notepaper wherein each sheet in the stack is adhered adhesively by a narrow band of readily releasable repositionable adhesive coated along one edge thereof to the next adjacent sheet along alternately opposite edges of successive sheets.

One such dispenser for the sheet material is shown in U.S. Pat. No. 4,416,392, assigned to the assignee of this application, wherein the stack of sheets are disposed in a box for dispensing through a slot positioned in the top of the box and centrally disposed parallel to the opposite edges of the sheets which are coated with the band of adhesive. Alternately, the subject patent discloses a dispenser for a stack of sheet material wherein a base is provided for supporting a removable cover within which is disposed the stack of sheet material. The cover is provided with an opening in the top wall and the stack of sheets are urged toward the top wall by a spring. The top wall is formed by two inclined portions which terminate at the dispensing opening. This dispenser comprises four basic parts to dispense the stack of sheets, and the sharp edges in the dispenser at the opening cause the sheets that were dispensed to become stressed during the dispensing action about the edges of the opening and thus retain a curl after the sheets were dispensed.

A second U.S. Pat. No. 4,653,666, assigned to the assignee of this application discloses a further embodiment of a dispenser for a stack of sheets. This dispenser comprises a box member which fits about the stack of sheets and has a centrally disposed opening transverse to the edges coated with the adhesive. A spring member in the box presses the stack of sheets toward the opening. Extending from the top wall of the box and into the opening are flexible polymeric flaps which during the dispensing opening define an arcuate wall about which the sheets are drawn as they are dispensed. This structure thus avoids the development of any curl forming in the dispensed sheets, and thus the sheets, after being dispensed and positioned on a receptor sheet lay flat and thus are not subject to becoming dislodged. It is advantageous that the sheets, after being dispensed, are not stressed to curl away from the receptor surface. This dispenser, as noted however, comprises a number of parts, and because it is formed from a box which is not refillable it lacks certain advantages. Further, the lightweight nature of the dispenser does not make it convenient as a desk dispenser since the sheets could not be removed from the box with one hand.

The present invention provides numerous improvements over the prior art dispenser structures. The dispenser of the present invention is a refillable desk-type dispenser. The dispenser is formed of few parts, two. The dispenser can be formed to be very attractive for use on the desk top.

The present invention provides a dispenser for the adhesive-coated notepapers which does not leave a curl in each sheet of paper after the same is dispensed.

SUMMARY OF THE INVENTION

The present invention is directed to a dispenser for sheets of notepaper disposed in a stack with each sheet having a narrow band of adhesive coated on one surface along one edge with the sheets stacked with the band of adhesive of adjacent sheets at alternate opposite edges of the stack. The dispenser comprises a body and a base. The base provides a support surface for a stack of notepaper having the area supporting the bottom sheet of the stack and formed to restrict movement of the stack of sheets. The body is adapted to rest on the top of the stack of sheets and has sufficient weight such that the dispensing action does not tend to lift the body or tilt it with respect to the stack of sheets. The body is formed with a surface to engage the sheets at the top of the stack and has arcuate wall members communicating with the surface engaging the top of the stack and with the edges of the dispensing opening in the top of the body. One of said base or body member has the surface contacting the stack of sheets disposed in spaced relation to the adjacent surface of the body or base to assure contact between such member and the last sheet in a stack.

It is preferable that the base and the body have aligned projections and corresponding recesses serving to nest the two members when the stack has been dispensed.

BRIEF DESCRIPTION OF THE DRAWINGS

The present invention will be further described with reference to the accompanying drawing wherein.

DETAILED DESCRIPTION

Figure 1:
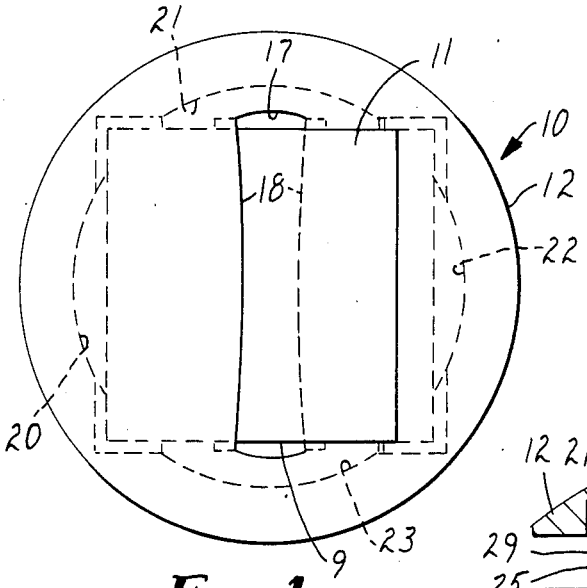
FIG. 1 is a top plan view of the dispenser of the present invention.

Referring now to FIGS. 1 through 5, there is disclosed a dispenser 10 for a stack 9 of sheets 11 wherein each sheet 11 has a narrow band of adhesive coated on one surface along one edge thereof. The sheets 11 are placed in a stack 9 with the band of adhesive of adjacent sheets being coated at alternate opposite edges of the stack. The dispenser comprises a body 12 and a base 14. In the embodiment of FIG. 1 the body 12 is weighted or formed of metal, such as brass, and has sufficient weight to counteract the forces applied thereagainst during the dispensing of sheet 11 such that it is not displaced or tilted with respect to the top of the stack 9 during the dispensing action. The dispensing forces are somewhat reduced because the body 12 is provided with arcuate wall members 15 which extend from a portion 16 of the bottom surface of the body which engages the top of a stack of sheets. The wall members 15 extend from the surface 16, positioned to engage the stack 9 of sheets 11 adjacent the opposite edges thereof to a dispensing opening generally designated 17, disposed centrally of the top surface of the body 12. The dispensing opening 17 is defined by opposed edges 18.

The bottom of the body 12 is recessed to receive the top of the stack of sheets 11 to a depth to the bottom wall or surface 16 and is provided with at least two, but as illustrated four, recesses 20, 21, 22, and 23 which are formed about the recess to receive projections, as will be described hereinafter, on the base 14 to nest the body 12 and the base 14.

Figure 3:
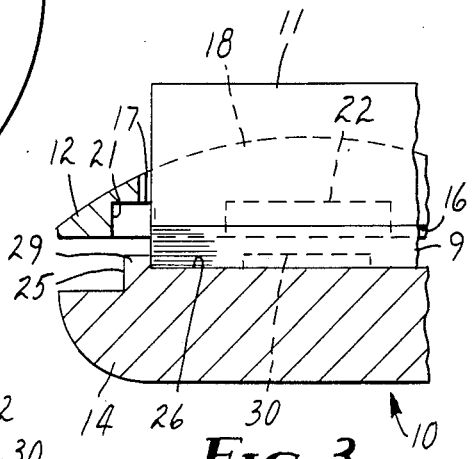
FIG. 3 is a fragmentary transverse sectional view of the dispenser of FIG. 2.
Figure 2:
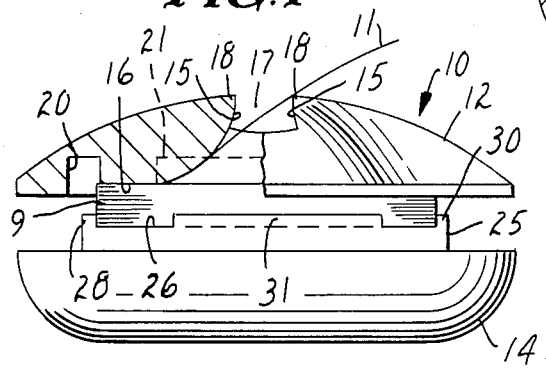
FIG. 2 is a side elevational view, partly in section, of the dispenser of FIG. 1.
Figure 4:
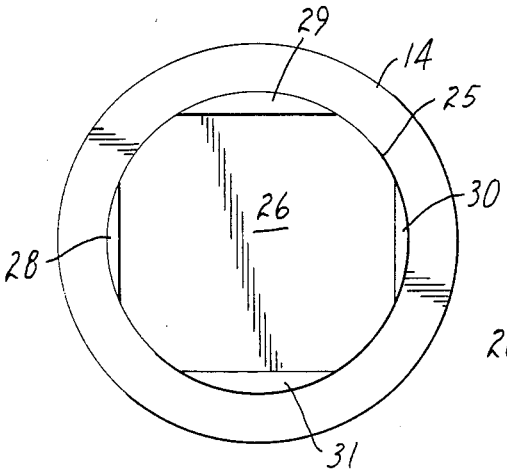
FIG. 4 is a top plan view of the base.
Figure 5:
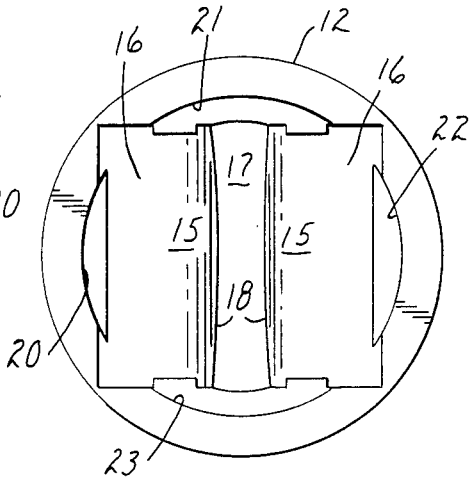
FIG. 5 is a bottom plan view of the body.

As noted in FIGS. 2 and 3, the base 14 is configured with an outer periphery corresponding to that of the body and has a pedestal or platform 25 in the center portion thereof which supports the stack 9 of sheets 11. This pedestal has an outer periphery which also corresponds to the configuration of the base but has a generally rectangular top support surface 26 to support the stack of sheets. Positioned about the surface 26 are projecting members 28, 29, 30, and 31. The projections 28-31 are shaped to define the rectangular support surface 26 and project thereabove to be received in the recesses 20, 21, 22, and 23 of the body. These projections serve also to nest the stack on the support surface 26 such that the stack is restricted from movement with respect to the support surface 26. The surface 26 will strike surface 16 before other parts of the body and base are in contact.

Referring now to the embodiment of FIGS. 6, 7, 8, and 9, it will be noted that the configuration differs and the rectangular recess is defined in the base rather than the body and that the projections project from the body into cooperating recesses in the base.

Figure 6:
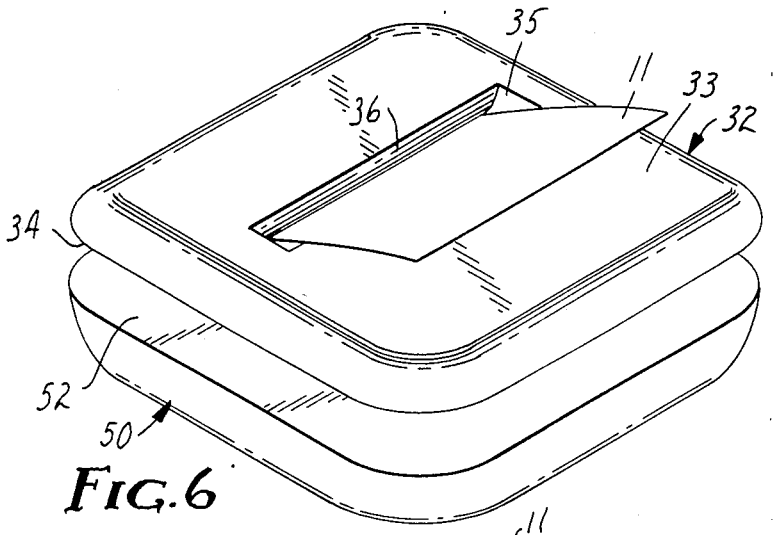
FIG. 6 is a perspective view of an alternative embodiment of the dispenser of the present invention.
Figure 7:
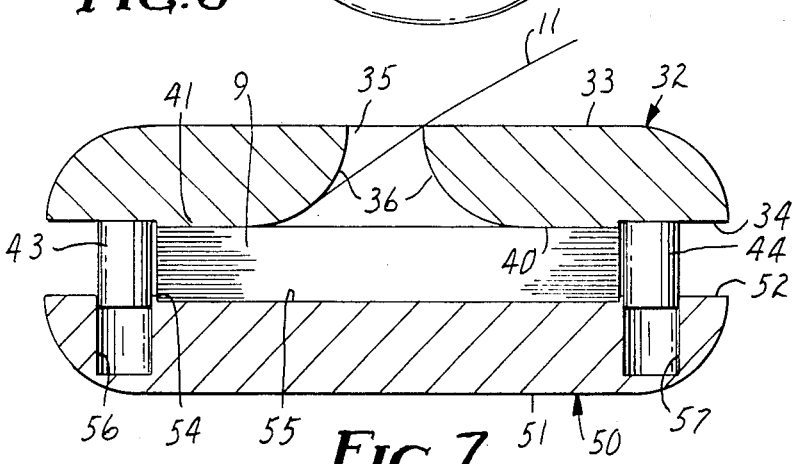
FIG. 7 is a longitudinal vertical sectional view of the dispenser of FIG. 6.
Figure 8:
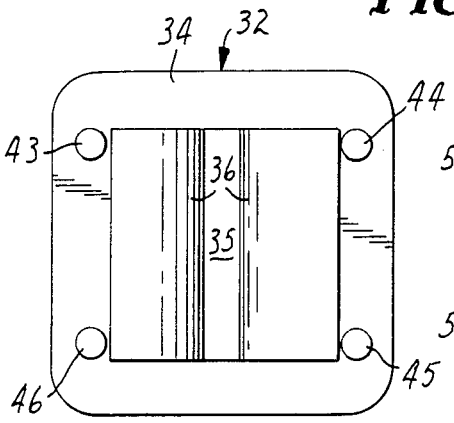
FIG. 8 is a bottom plan view of the body of the dispenser of FIG. 6.
Figure 9:
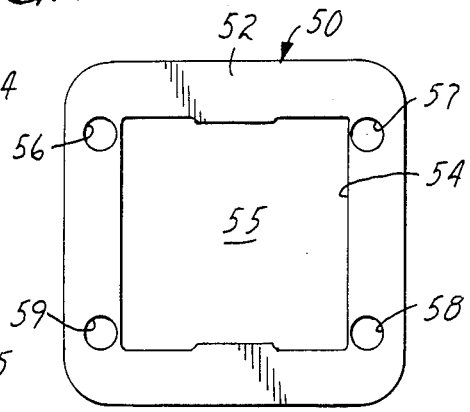
FIG. 9 is a top plan view of the base of the dispenser of FIG. 6.

FIG. 6 illustrates a dispenser having a body 32 with an upper surface 33 and a lower surface 34. A generally centrally disposed dispensing opening 35 is disposed in the upper surface 33 and communicates with arcuate wall members 36 which communicate with a rectangular surface portion 40 of the bottom surface 34. Surface 40 is on a platform or pedestal 41 that projects below the surface 34 of the body 32. Extending from the body surface 34 is also a plurality of projections 43, 44, 45, and 46 which are disposed adjacent the periphery of the surface 40 to restrict the stack 9 of sheets 11 from moving with respect to the surface 40. The base 50 is provided with a bottom surface 51 and an upper surface 52 which has generally rectangular shaped recessed area 54 shaped to receive a stack of sheets 11. The depth of the recess 54 to the surface portion 55 does not exceed the height of the pedestal from surface 34 to the surface 40 such that the last sheet 11 of a stack 9 would be dispensed from the recess 54 before contact was made between the surface 40 and the bottom wall or surface 55 of the recess 54, before surface 34 touches surface 52 and before the extended ends of projections 43–46 strike the bottom of recesses 56–59. Surrounding the periphery of the recess 54 are the series of recesses 56, 57, 58, and 59 shaped to cooperate with the projections 43, 44, 45, and 46 to nest the body 32 with the base 50.

In each of these embodiments the body is preferably formed to have a weight of between about 16 ounces and 24 ounces to exceed the force of drawing a sheet 11 through the dispensing opening and peeling the sheet from the surface of the next adjacent sheet in the stack. In the embodiment of FIG. 6 the projections 43, 44, 45, and 46 may at all times be engaged in the openings 56, 57, 58, and 59 to restrict movement of the body 32 with respect to the base 50 if the height of the stack is limited. The engagement of the projections with the base or projections in the base contacting the body add resistance to any movement and thus the amount of weight in the body could be reduced. The weighted body in the above-stated range however is preferred in that it makes the dispenser more stable on the desk so that the total dispenser is not moved upon dispensing action on a sheet of notepaper. The weight of the body also results from factors such as the coefficient of friction of the walls 15 and 36 and the paper weight and finish. The body and base can be formed of the same material or different materials to provide an attractive dispenser, e.g. brass and walnut, plastic and a wood, wood with metal projections 43–46 for weight, etc. The thickness of the body also is of assistance in having the free end of the sheet 11 projecting upward where it is easily grasped to be withdrawn from the dispenser.

Having thus described the present invention with respect to preferred embodiments thereof it will be appreciated that further changes may be made without departing from the spirit or scope of the invention.

I claim:

1. A dispenser for sheets of notepaper disposed in a stack with each of said sheets having a narrow band of adhesive coated on one surface along one edge by which the sheets are adhered together and with the sheets being stacked with the band of adhesive of adjacent sheets at alternate opposite edges of the tack, said dispenser comprising:

a body part and a base part, said body part having a top surface, a bottom surface including spaced generally planar portions and convex arcuate portions having a large radius between said planar portions and said top surface defining a narrow slot through and extending centrally across said body, said base part having a bottom surface and a top surface comprising a generally planar portion, one of said parts including a projecting platform providing one of said planar surface and planar surface portions and the other of said parts having a recess adapted to receive and orient a said stack of sheets and adapted to receive said platform and providing the other one of said planar surface and planar surface portions, the projecting height of said platform being equal to or greater than the depth of the recess so that said planar surface and planar surface portions can engage, said planar surface on said base being adapted to receive and support the bottom of a said stack of sheets and said spaced surface portions being adapted to rest on the top of the stack of sheets.

2. A dispener according to claim 1 wherein said body part has said recess and said base part includes said platform.

3. A dispenser according to claim 2, wherein said base part has a plurality of projections projecting past the planar surface of said platform and positioned about the periphery of said platform, and said body has sockets adapted to receive said projections when said body is positioned on said base with said planar surface and planar surface portions in contact.

4. A dispenser according to claim 3, wherein said body part has sufficient weight to overcome the force needed to withdraw said sheet through said slot from a said stack of sheets disposed below said body part.

5. A dispenser according to claim 3, wherein said projections are along edges of said platform and are positioned to orient a said stack on said planar surface.

6. A dispenser according to claim 3, wherein said body is metal.

7. A dispenser according to claim 6, wherein said metal is brass.

8. A dispenser according to claim 1 wherein said base part has said recess and said body part includes said platform.

9. A dispenser according to claim 8, wherein said body part has a plurality of projections projecting past said planar surface portions and said base part has a plurality of sockets receiving said projections when said body part is positioned on said base part.

10. A dispenser according to claim 9, wherein said body part has sufficient weight to overcome the force needed to withdraw a said sheet from a said stack disposed below said body part.

11. A dispenser according to claim 9, wherein said projections are cylindrical, have axes, project with said axes disposed at about right angles with respect to said planar surface portions, and have lengths sufficient to position at least end portions of said projections in said sockets when a said pad is positioned between said body part and said base part.

12. A dispenser according to claim 1, wherein said body part has sufficient weight to overcome the fore needed to draw a said sheet rom a said stack of sheets disposed between said base part and said body part through said narrow slot.

* * * * *